US007523508B2

(12) United States Patent
Contant et al.

(10) Patent No.: US 7,523,508 B2
(45) Date of Patent: Apr. 28, 2009

(54) HOCKEY PANTS

(75) Inventors: Mathieu Contant, Verdun (CA); Jean-François Laperriére, St-Sauveur (CA)

(73) Assignee: Bauer Hockey, Inc., St-Jérôme, Québec (CA)

( * ) Notice: Subject to any disclaimer, the term of this patent is extended or adjusted under 35 U.S.C. 154(b) by 658 days.

(21) Appl. No.: 11/212,752

(22) Filed: Aug. 29, 2005

(65) Prior Publication Data

US 2007/0044212 A1 Mar. 1, 2007

(51) Int. Cl.

| | |
|---|---|
| ***A41D 1/06*** | (2006.01) |
| ***A41D 13/02*** | (2006.01) |
| ***A41D 13/015*** | (2006.01) |
| ***A62B 17/00*** | (2006.01) |
| ***F41H 1/00*** | (2006.01) |
| ***G21F 3/02*** | (2006.01) |

(52) U.S. Cl. ..... 2/227; 2/455

(58) Field of Classification Search ..... 2/69, 2/22, 23, 79, 227, 228, 229, 267, 455, 911, 2/464, 465

See application file for complete search history.

(56) References Cited

U.S. PATENT DOCUMENTS 4,325,148 A * 4/1982 Livernois ..... 2/465
4,577,346 A * 3/1986 Hall ..... 2/464
5,007,108 A * 4/1991 Laberge et al. ..... 2/463
5,572,737 A * 11/1996 Valice ..... 2/465
5,966,739 A 10/1999 Wagner

* cited by examiner

*Primary Examiner*—Gary L. Welch
*Assistant Examiner*—Amber R Anderson

(57) ABSTRACT

Hockey pants for protecting a wearer having a lower spine region, lower ribs, a waist region, left and right hip regions, a crotch region, and left and right thighs, the pants comprising an inner protective unit comprising first, second and third left separate protective pads and first, second and third right separate protective pads for covering the respective left and right hip regions, the first, second and third left pads being connected together by a first elastic band and the first, second and third right pads being connected together by a second elastic band, each of the first and second elastic bands allowing movement of the third and second pads relative to the respective second and first pads between an extended position, wherein there is first overlappings between the respective third and second pads and second and first pads, and a retracted position, wherein there is second overlappings between the respective third and second pads and second and first pads, the second overlappings being larger than the first overlappings.

18 Claims, 6 Drawing Sheets

HOCKEY PANTS

FIELD OF THE INVENTION

The present invention relates to hockey pants having overlapping protective pads for covering the hips of the wearer.

BACKGROUND OF THE INVENTION

Traditional hockey pants protect the area of the wearer that is delimited, at an upper end, by the waist and, at a lower end, by the knees. Protection is therefore provided to the upper leg and pelvic regions of the wearer. These pants may comprise an adjustable dorsal protective pad adapted to extend over and protect the lower spine region of the wearer.

Traditional hockey pants have inner protective pads that do not necessarily follow the contour of the hip regions when the wearer adopts different skating positions.

There is therefore a need for hockey pants offering an appropriate level of protection while allowing greater mobility to the wearer.

SUMMARY OF THE INVENTION

As embodied and broadly described herein, the present invention provides hockey pants for protecting a wearer having a lower spine region, lower ribs, a waist region, left and right hip regions, a crotch region, and left and right thighs. The hockey pants have an inner protective unit comprising left separate protective pads and right separate protective pads for covering the respective left and right hip regions, each of the left and right separate protective pads comprising a first pad and a second pad partially overlapping the first pad, the first and second pads being connected together by an elastic band allowing movement of the second pad relative to the first pad between an extended position, wherein there is a first overlapping between the first and second pads, and a retracted position, wherein there is a second overlapping between the first and second pads, the second overlapping being larger than the first overlapping. The hockey pants may also have a third pad overlapping the second pad and being connected to the second pad by the elastic band that allows movement of the third pad relative to the second pad between an extended position, wherein there is a first overlapping between the second and third pads, and a retracted position, wherein there is a second overlapping between the second and third pads, the second overlapping being larger than the first overlapping.

The invention also provides hockey pants for protecting a wearer having a lower spine region, lower ribs, a waist region, left and right hip regions, a crotch region, and left and right thighs, the pants comprising an inner protective unit comprising first, second and third left separate protective pads and first, second and third right separate protective pads for covering the respective left and right hip regions, the first, second and third left pads being connected together by a first elastic band and the first, second and third right pads being connected together by a second elastic band, each of the first and second elastic bands allowing movement of the third and second pads relative to the respective second and first pads between an extended position, wherein there is first overlappings between the respective third and second pads and second and first pads, and a retracted position, wherein there is second overlappings between the respective third and second pads and second and first pads, the second overlappings being larger than the first overlappings.

Other aspects and features of the present invention will become apparent to the persons skilled in the art upon review of the following description of embodiments of the invention in conjunction with the accompanying figures.

BRIEF DESCRIPTION OF THE DRAWINGS

A detailed description of the embodiments of the present invention is provided herein below, by way of example only, with reference to the accompanying drawings, in which.

Figure 1:
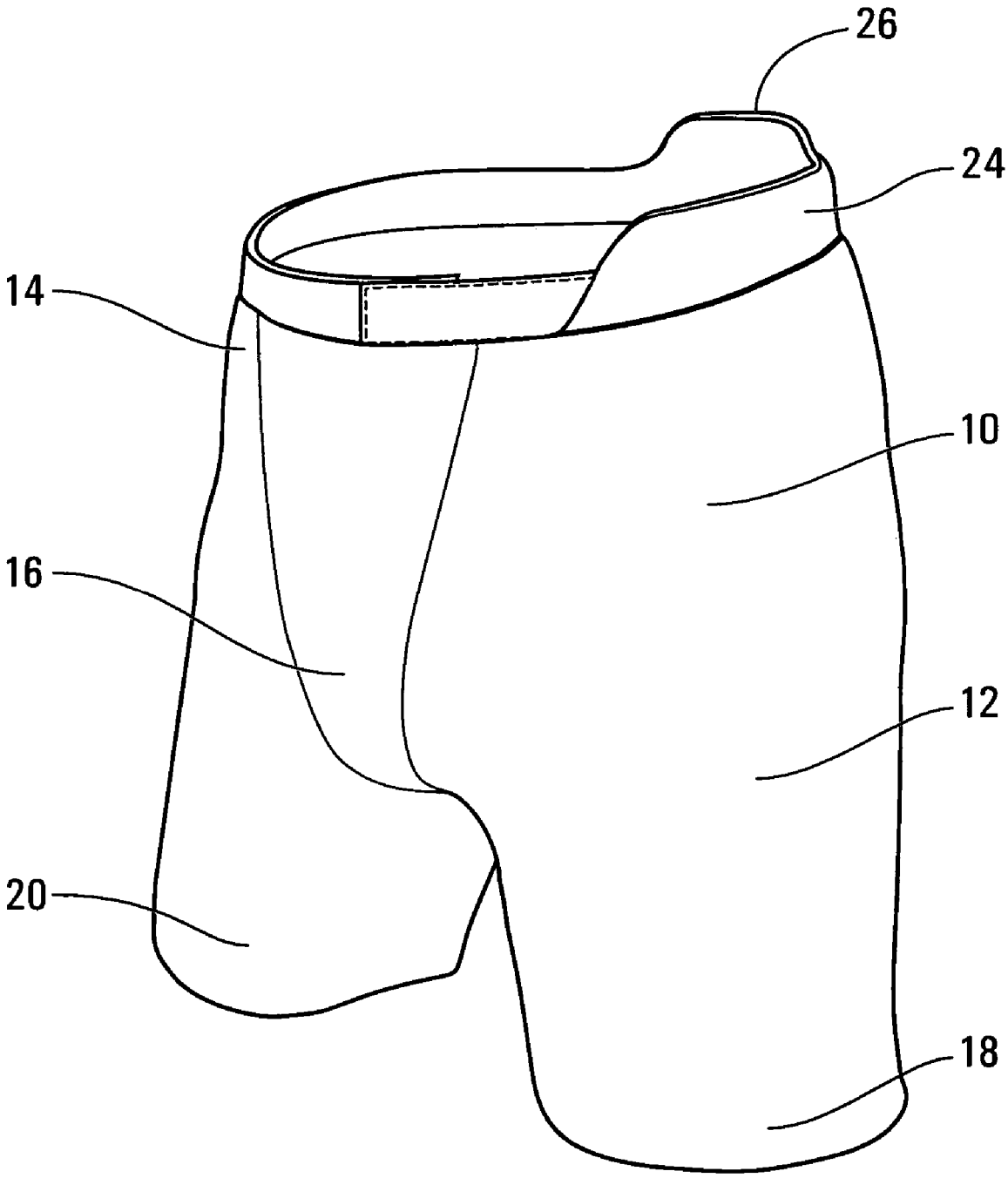
FIG. 1 is a perspective view of the hockey pants constructed in accordance with the invention.
Figure 2:
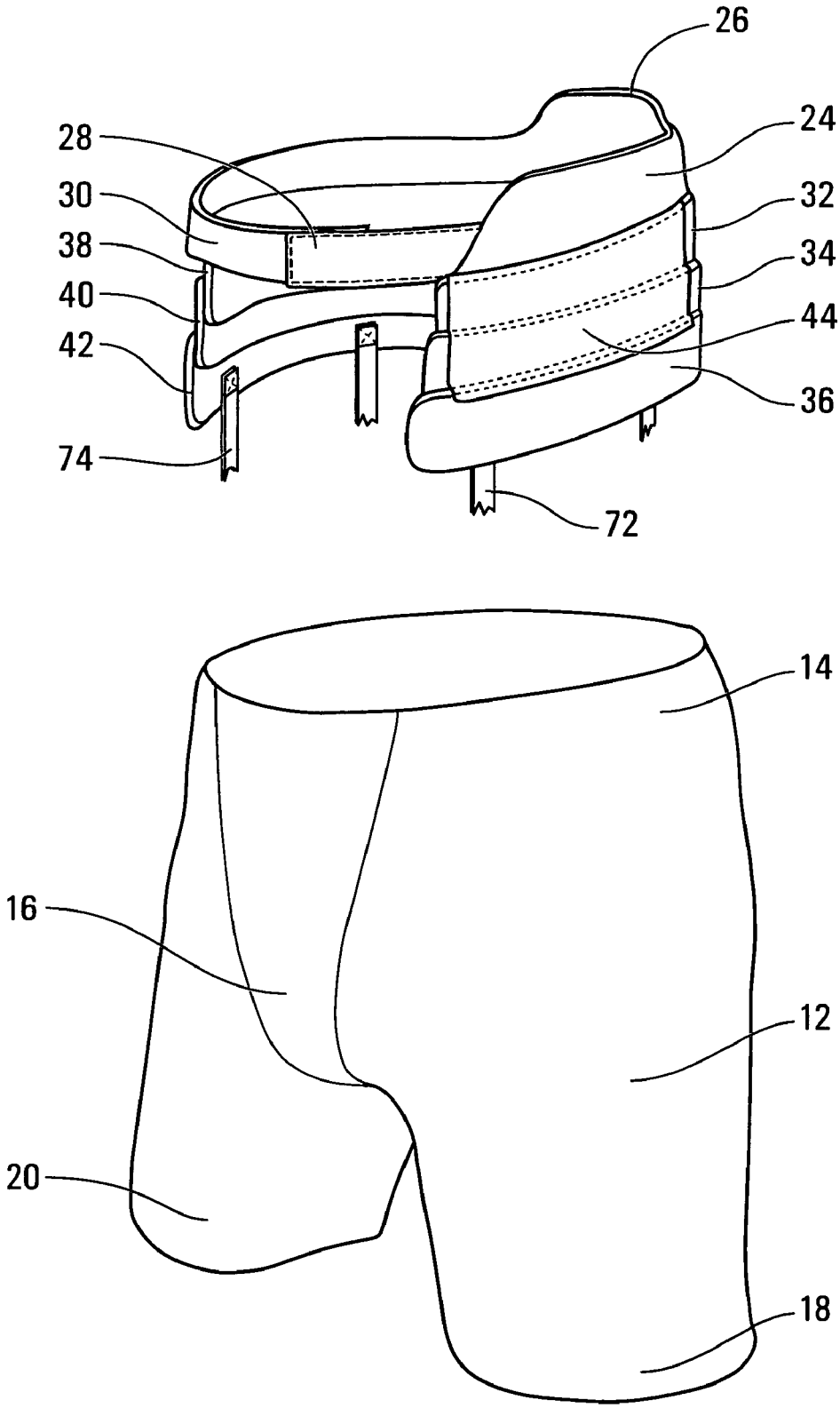
FIG. 2 is a perspective view of the hockey pants of FIG. 1 showing the inner protective unit and the outer shell.
Figure 3:
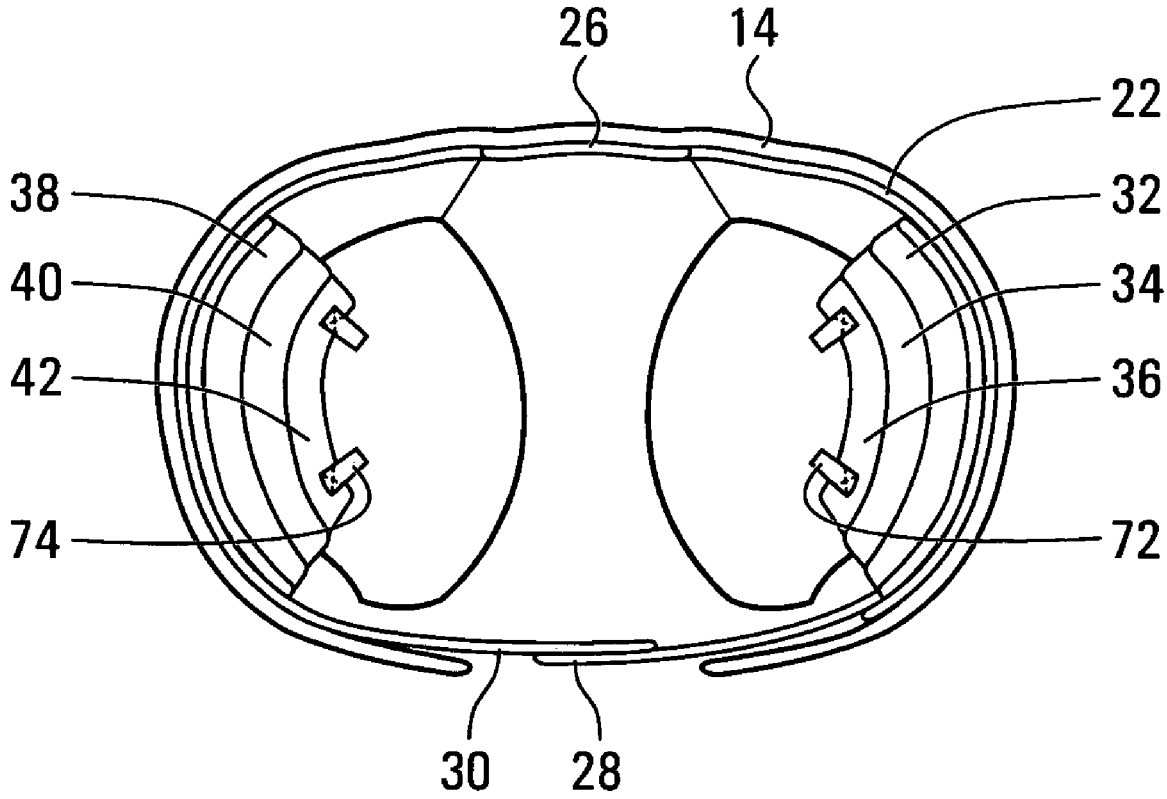
FIG. 3 is a top view of the hockey pants of FIG. 1.

In the drawings, the embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS

To facilitate the description, any reference numerals designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Shown in FIGS. 1 to 7 is the hockey pants 10 constructed in accordance with an embodiment of the present invention and adapted for being worn by a wearer having a lower spine region, lower ribs, a waist region, left and right hip regions, a crotch region, and left and right thighs.

The hockey pants 10 comprises an outer shell 12 having an upper portion 14 for covering the waist and left and right hip regions of the wearer, a crotch portion 16 for covering the crotch region of the wearer and left and right leg portions 18, 20 for covering the respective left and right thighs of the wearer. The outer shell 12 may be made of a single or multi layer nylon material that is resistant to rib and cuts. Other synthetic and natural materials are likewise contemplated for alternate embodiments. The outer shell 12 should be made of a water resistant material so that water from the ice does not soak through the pants and reach the wearer's skin. The left and right leg portions 18, 20 are of tubular configuration to encircle the left and right thighs of the wearer. As it is well known in the art, the left and right leg portions 18, 20 comprise inner pockets for receiving protective pads for covering the front, side and back areas of the left and right thighs of the wearer. Each of these protective pads may have a certain curvature in order to better follow the contour of the thighs of the wearer. The left and right leg portions 18, 20 may also comprise elastic regions allowing greater mobility to the wearer.

The pants 10 also comprise an inner protective unit 22 associated with the outer shell 12. The upper edge of the outer shell 12 may be affixed to the inner protective unit by affixing means such as adhesive, thermal bonding, piping, zipper or stitches.

The protective unit 22 comprises a padded band 24 for covering the waist region of the wearer. The padded band 24 may comprise a back portion 26 extending upwardly for covering the lower spine region of the wearer. It is understand that the padded band 24 may also at least partially cover the lower ribs of the wearer. The padded band 24 further comprises left and right belt portions 28, 30 that are interconnectable by affixing together respective rear and front overlapping surfaces of these left and right belt portions 28, 30 while allowing their size adjustment relative to the waist region of the wearer. One of the overlapping surfaces of the left and right belt portions 28, 30 may comprise VELCRO loops and the other overlapping surfaces may comprise VELCRO hooks.

The protective unit 22 may also comprise an adjustable belt located below the left and right belt portions 28, 30 in order to offer further size adjustment relative to the waist region of the wearer. The belt may be tightened in place by adjusting a suitable buckle. Adjustment of the left and right belt portions 28, 30 and belt is performed such that they snugly fits and encircles the waist region of the wearer.

The protective unit 22 comprises left first, second, third separate protective pads 32, 34, 36 for covering the left hip region of the wearer and right first, second, third separate protective pads 38, 40, 42 for covering the right hip region of the wearer.

The first, second, third pads 32, 34, 36 are connected by an elastic band 44 and the first, second, third pads 38, 40, 42 are also connected by an elastic band 46. It is understand that the elastic bands 44, 46 may be integrated elastic bands as shown in the figures or may be formed of separate elastic bands, first elastic bands connecting the respective first and second pads 32, 24; 38, 40 and second elastic bands connecting the respective second and third pads.

Figure 4:
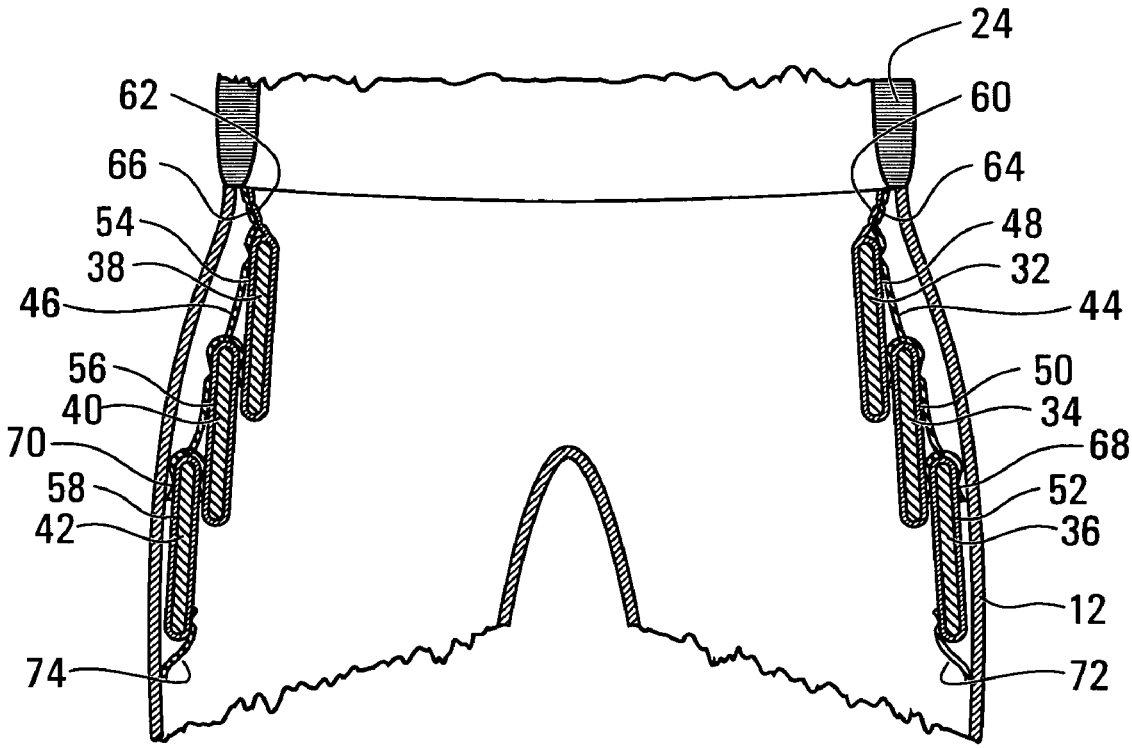
FIG. 4 is an enlarged cross sectional view showing overlapping protective pads of the inner protective unit in an extended position.
Figure 5:
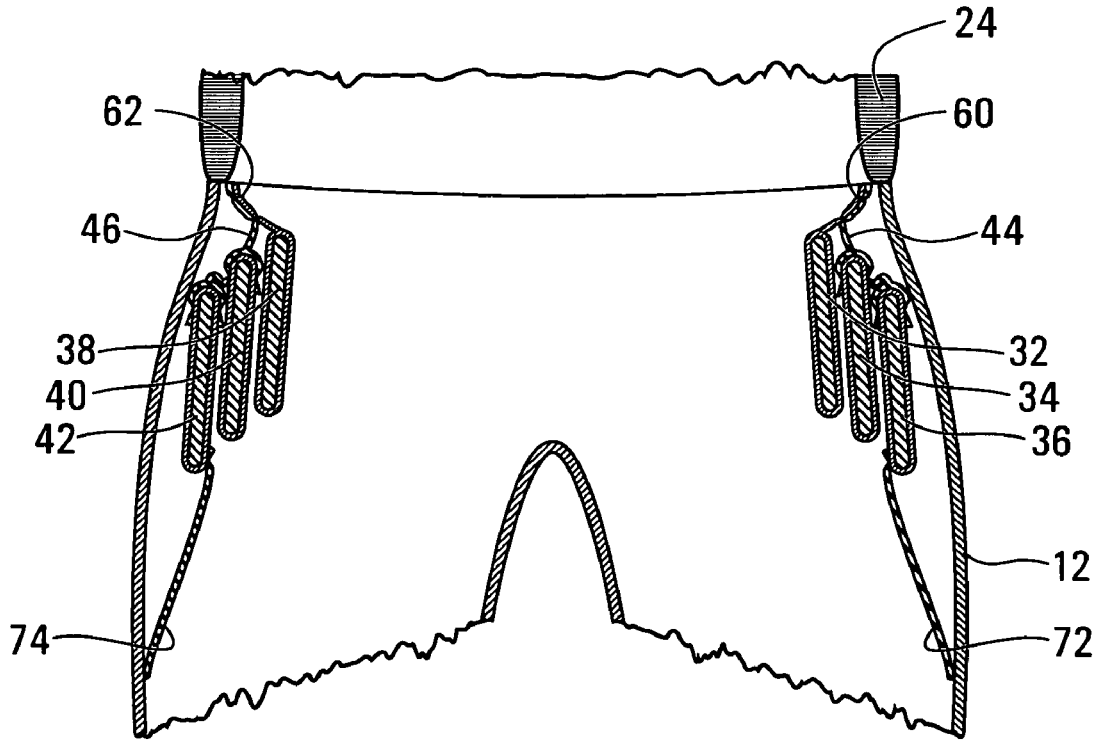
FIG. 5 is an enlarged cross sectional view showing overlapping protective pads of the inner protective unit in a retracted position.

As shown in FIGS. 4 and 5, the elastic band 44 allows movement of the second pad 34 relative to the first pad 32 between an extended position (see FIG. 4), wherein there is a first overlapping between the first and second pads 32, 34, and a retracted position (see FIG. 5), wherein there is a second overlapping between the first and second pads 32, 34, this second overlapping being larger than the first overlapping. The elastic band 44 also allows movement of the third pad 36 relative to the second pad 34 between an extended position (see FIG. 4), wherein there is a first overlapping between the second and third pads 34, 36, and a retracted position (see FIG. 5), wherein there is a second overlapping between the second and third pads 34, 36, this second overlapping being larger than the first overlapping.

Similarly, the elastic band 46 allows movement of the second pad 40 relative to the first pad 38 between an extended position (see FIG. 4), wherein there is a first overlapping between the first and second pads 38, 40, and a retracted position (see FIG. 5), wherein there is a second overlapping between the first and second pads 38, 40, this second overlapping being larger than the first overlapping. The elastic band 46 also allows movement of the third pad 42 relative to the second pad 40 between an extended position (see FIG. 4), wherein there is a first overlapping between the second and third pads 40, 42, and a retracted position (see FIG. 5), wherein there is a second overlapping between the second and third pads 40, 42, this second overlapping being larger than the first overlapping.

Figure 6:
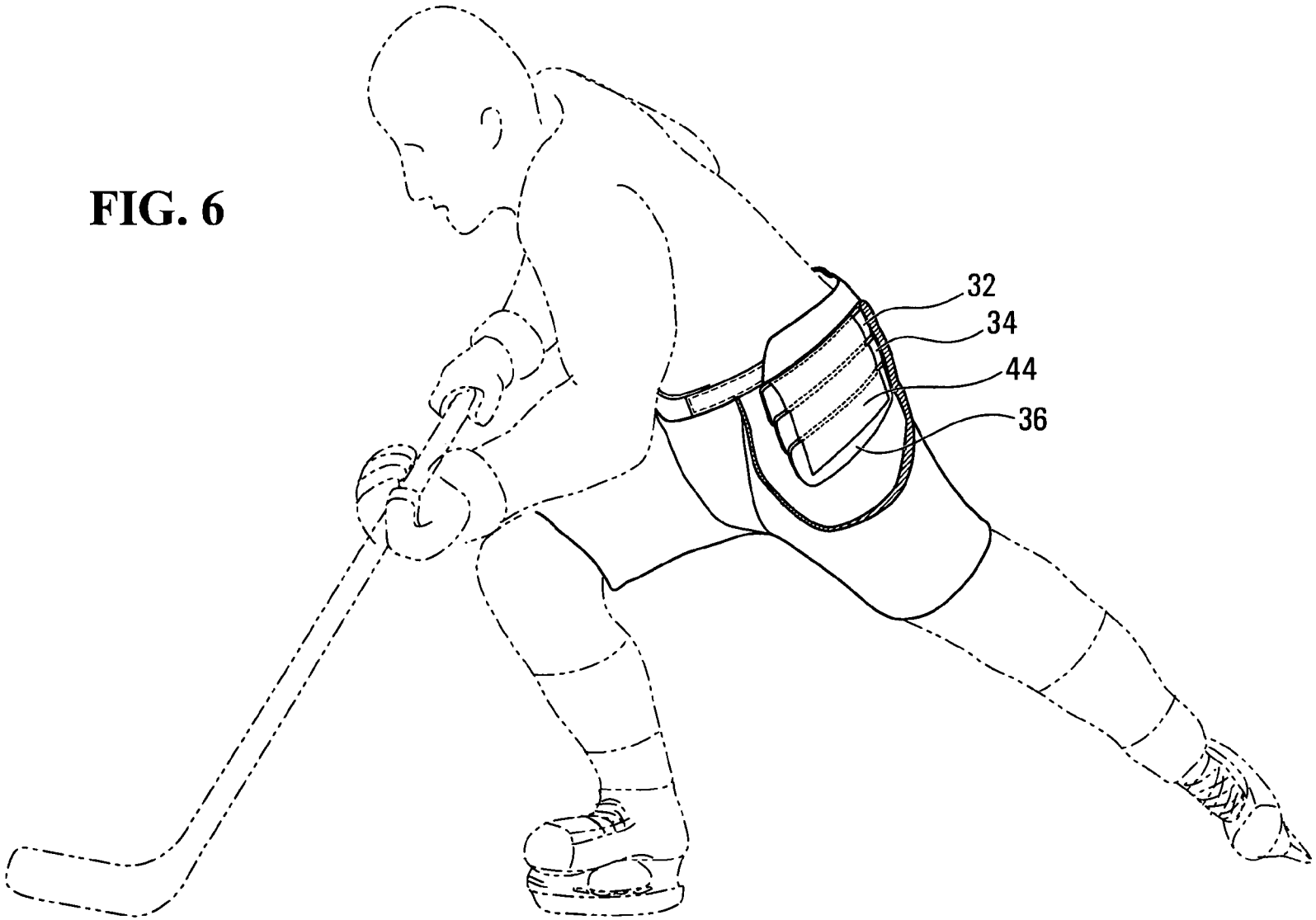
FIG. 6 is a perspective view of a player wearing the hockey pants of FIG. 1 wherein a portion of the outer shell is broken to show the overlapping protective pads in the extended position.
Figure 7:
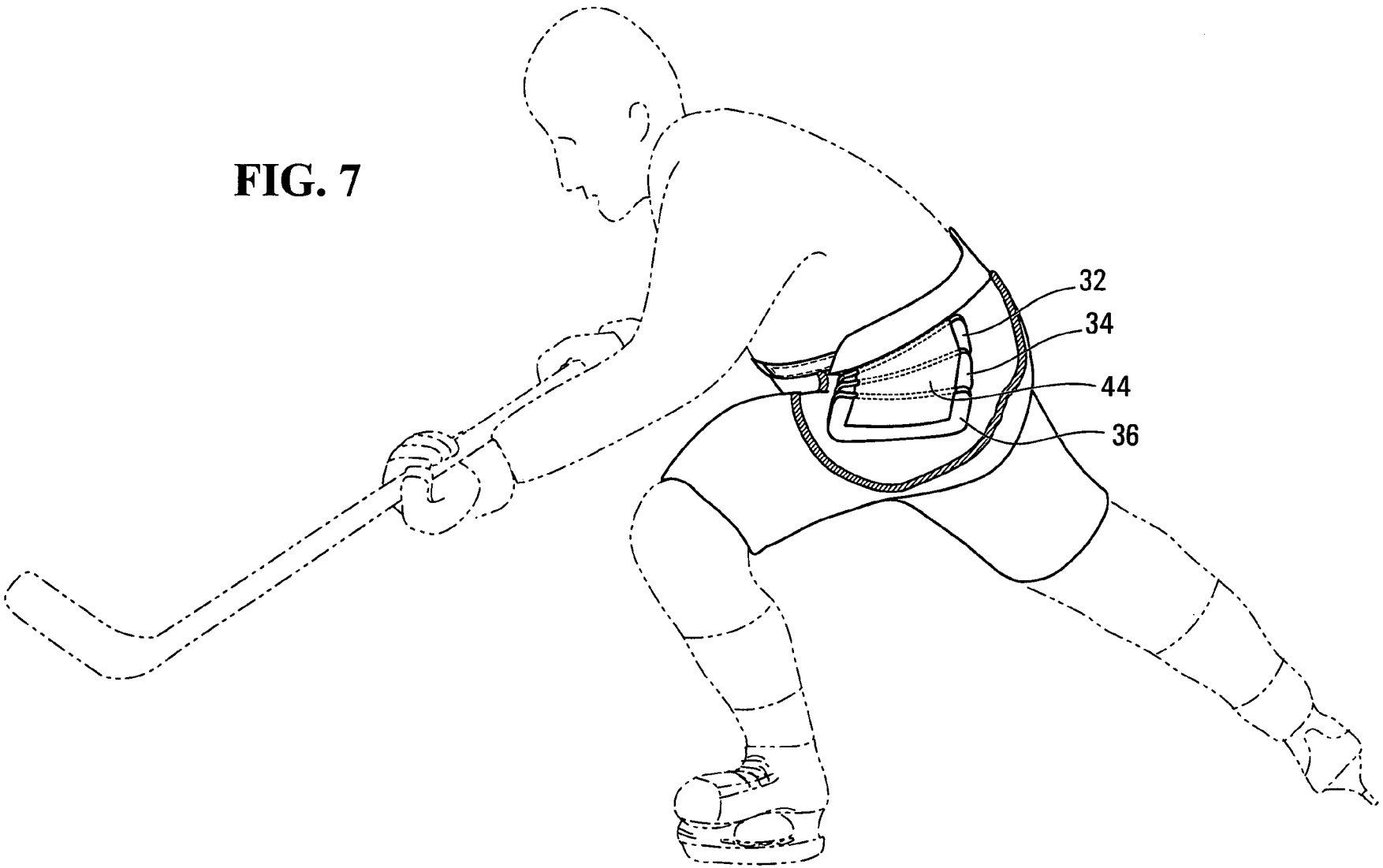
FIG. 7 is a perspective view of a player wearing the hockey pants of FIG. 1 wherein a portion of the outer shell is broken to show the overlapping protective pads in the retracted position.

FIGS. 6 and 7 show a player in different skating positions. In FIG. 6, the right leg of the player begins the pushing action against the ice while the left leg reaches full extension after its pushing action. In this full extension position, the left leg is generally straight and the pads 32, 34, 36 are in the extended position wherein movement of the left leg is not restricted. In FIG. 7, the left leg is bent and the pads 32, 34, 36 are then in the retracted position wherein movement of the left leg is not restricted. It is understood that the hockey pants 10 may also be worn by a goaltender who also needs flexibility in the hip regions when for example moving from a stand-up position to a "butterfly style" position.

Reverting to FIGS. 4 and 5, the first, second, third pads 32, 34, 36 are confined in respective envelopes 48, 50, 52 and the first, second, third pads 38, 40, 42 are also confined in respective envelopes 54, 56, 58. The first envelopes 48, 54 have respective upper edges 60, 62 affixed to the padded band 24. The upper edges 60, 62 may be stitched to an inner surface of the padded band 24.

The elastic bands 44, 46 have respective upper ends 64, 66 also affixed to the padded band 24. The upper ends 64, 66 of the elastic bands 44, 46 may be stitched to the inner surface of the padded band 24, proximate to the respective upper edges 60, 62 of the first envelopes 48, 54. The elastic bands 44, 46 may also be stitched to an upper edge of the respective first pads 32, 38. The elastic bands 44, 46 also have respective lower ends 68, 70 stitched to an upper edge of the respective third pads 36, 42. Moreover, the elastic bands 44, 46 are stitched to an upper edge of the respective second pads 34, 40 at about mid distance.

The length of the elastic bands 44, 46 is selected such that, in the extended position, the third pads 36, 42 at least partially overlap the respective second pads 34, 40 and the second pads 34, 40 at least partially overlap the respective first pads 32, 38 as shown in FIG. 4.

The left and right first, second and third separate protective pads 32, 34, 36; 38, 40, 42 may be made of thermoformable foam or any other suitable energy absorption material while the respective envelopes 48, 50, 52; 54, 56, 58 and elastic bands 44, 46 may be made of fabric or any other suitable elastic material.

The pants 10 may also comprise left and right elastic bands 72, 74 having an upper end affixed to a lower edge of the third pad 36; 42 and a lower end affixed to the inner surface of the leg portion 18; 20.

The above description of embodiments should not be interpreted in a limiting manner since other variations, modifications and refinements are possible within the spirit and scope of the present invention. The scope of the invention is defined by the appended claims and their equivalents.

The invention claimed is:

1. Hockey pants for protecting a wearer having a lower spine region, lower ribs, a waist region, left and right hip regions, a crotch region, and left and right thighs, said hockey pants comprising an inner protective unit and an outer shell with its upper edge connected to said inner protective unit, said outer shell having an upper portion for covering the waist and left and right hip regions of the wearer, a crotch portion for covering the crotch region of the wearer and left and right leg portions for covering the respective left and right thighs of the wearer, said inner protective unit comprising a padded band for covering the waist region of the wearer, left separate first and second protective pads and right separate first and second protective pads for covering the respective left and right hip regions, a first elastic band connecting said left first and second protective pads and a second elastic band connecting said right first and second protective pads, wherein said first elastic band has an upper end affixed to a left inner surface of said padded band of said inner protective unit and a lower end affixed to an upper edge of said left second protective pad, wherein said second elastic band has an upper end affixed to a right inner surface of said padded band of said inner protective unit and a lower end affixed to an upper edge of said right second protective pad, wherein, in use, each of said first and second elastic bands allows movement of each second protective pad relative to each first protective pad between an extended position, wherein there is a first overlapping between said first and second protective pads, and a retracted position, wherein there is a second overlapping between said first and second protective pads, said second overlapping being larger than said first overlapping, and wherein said hockey pants further comprise left and right elastic bands connecting said respective second left and right protective pads to an inner surface of said respective left and right leg portions of said outer shell, each of said left and right elastic bands biasing said first and second protecting pads towards said extended position.

2. Hockey pants in accordance to claim 1, wherein said first and second elastic bands are also affixed to an upper edge of said respective left and right first protective pads.

3. Hockey pants in accordance to claim 1, wherein said left and right first protective pads are confined in respective left and right first envelopes and said left and right second protective pads are confined in respective left and right second envelopes.

4. Hockey pants in accordance to claim 1, wherein said padded band of said inner protective unit comprises a back portion for protecting the lower spine region of the wearer.

5. Hockey pants in accordance to claim 1, wherein said padded band of said inner protective unit comprises respective left and right belt portions that are interconnectable by affixing together respective rear and front overlapping surfaces of said left and right belt portions while allowing size adjustment of said left and right belt portions.

6. Hockey pants in accordance to claim 5, wherein one of said rear and front overlapping surfaces of said left and right belt portions comprises loop fasteners and the other of said one of said rear and front overlapping surfaces of said left and right belt portions comprises hook fasteners.

7. Hockey pants in accordance to claim 1, wherein said outer shell comprises an adjustable belt allowing size adjustment of said hockey pants around the waist of the wearer.

8. Hockey pants in accordance to claim 1, wherein each protective pad is made of thermoformable foam.

9. Hockey pants for protecting a wearer having a lower spine region, lower ribs, a waist region, left and right hip regions, a crotch region, and left and right thighs, said hockey pants comprising an inner protective unit and an outer shell with its upper edge connected to said inner protective unit, said outer shell having an upper portion for covering the waist and left and right hip regions of the wearer, a crotch portion for covering the crotch region of the wearer and left and right leg portions for covering the respective left and right thighs of the wearer, said inner protective unit comprising a padded band for covering the waist region of the wearer, separate left first, second and third protective pads and separate right first, second and third protective pads for covering the respective left and right hip regions, first and third elastic bands connecting said left first, second and third protective pads and second and fourth elastic bands connecting said right first, second and third protective pads, wherein said first elastic band has an upper end affixed to a left inner surface of said padded band of said inner protective unit, wherein said second elastic band has an upper end affixed to a right inner surface of said padded band of said inner protective unit, wherein said third elastic band has a lower end affixed to an upper edge of said left third protective pad, wherein said fourth elastic band has a lower end affixed to an upper edge of said right third protective pad, wherein, in use, each of said first and second elastic bands allows movement of each second protective pad relative to each first protective pad between an extended position, wherein there is a first overlapping between said first and second protective pads, and a retracted position, wherein there is a second overlapping between said first and second protective pads, said second overlapping being larger than said first overlapping, and each of said third and fourth elastic bands allows movement of each third protective pad relative to each second protective pad between an extended position, wherein there is a first overlapping between said second and third protective pads, and a retracted position, wherein there is a second overlapping between said second and third protective pads, said second overlapping being larger than said first overlapping, and wherein said hockey pants further comprise left and right elastic bands connecting said respective left and right third protective pads to an inner surface of said respective left and right leg portions of said outer shell, each of said left and right elastic bands biasing said first, second and third protective pads towards said extended position.

10. Hockey pants in accordance to claim 9, wherein said first and second elastic bands are also affixed to an upper edge of said respective left and right first protective pads.

11. Hockey pants in accordance to claim 9, wherein said left and right first protective pads are confined in respective left and right first envelopes, said left and right second protective pads are confined in respective left and right second envelopes, and said left and right third protective pads are confined in respective left and right third envelopes.

12. Hockey pants in accordance to claim 9, wherein said first and third elastic bands are integrally formed together to form a left integrated band and said second and fourth elastic bands are integrally formed together to form a right integrated band.

13. Hockey pants in accordance to claim 12, wherein said left integrated band is also affixed to an upper edge of said respective left first and second protective pads and said right integrated band is also affixed to an upper edge of said respective right first and second protective pads.

14. Hockey pants in accordance to claim 12, wherein said padded band comprises a back portion for protecting the lower spine region of the wearer.

15. Hockey pants in accordance to claim 12, wherein said padded band comprises respective left and right belt portions that are interconnectable by affixing together respective rear and front overlapping surfaces of said left and right belt portions while allowing size adjustment of said left and right belt portions.

16. Hockey pants in accordance to claim 12, wherein one of said rear and front overlapping surfaces of said left and right belt portions comprises loop fasteners and the other of said one of said rear and front overlapping surfaces of said left and right belt portions comprises hook fasteners.

17. Hockey pants in accordance to claim 12, wherein said outer shell comprises an adjustable belt allowing size adjustment of said hockey pants around the waist of the wearer.

18. Hockey pants in accordance to claim 12, wherein each protective pad is made of thermoformable foam.

* * * * *